US006874702B2

(12) United States Patent
Turnbull

(10) Patent No.: US 6,874,702 B2
(45) Date of Patent: Apr. 5, 2005

(54) MODULAR SPRAY GUN APPARATUS AND METHODS

(75) Inventor: Clifford W. Turnbull, Auburn, WA (US)

(73) Assignee: Micron Technology, Inc., Boise, ID (US)

( * ) Notice: Subject to any disclaimer, the term of this patent is extended or adjusted under 35 U.S.C. 154(b) by 111 days.

(21) Appl. No.: 10/267,632

(22) Filed: Oct. 8, 2002

(65) Prior Publication Data

US 2004/0065755 A1 Apr. 8, 2004

(51) Int. Cl.[7] ..... B05B 9/01
(52) U.S. Cl. ..... 239/526; 239/398; 239/527
(58) Field of Search ..... 239/345, 379, 239/398, 417.3, 417.5, 418, 419.5, 525, 526, 527, 600

(56) References Cited

U.S. PATENT DOCUMENTS

| | | | | |
|---|---|---|---|---|
| 3,374,406 A | | 5/1973 | Runstadler, Jr. et al. | 239/8 |
| 3,896,994 A | | 7/1975 | Walberg | 239/3 |
| 4,456,180 A | | 6/1984 | Lury | 239/397 |
| 4,483,483 A | | 11/1984 | Grime | 239/526 |
| 4,537,357 A | | 8/1985 | Culbertson et al. | 239/290 |
| 4,739,933 A | | 4/1988 | Hanano | 239/304 |
| 4,776,517 A | * | 10/1988 | Heren | 239/391 |
| 4,805,814 A | | 2/1989 | Allen, Sr. | 222/538 |
| 4,817,872 A | | 4/1989 | Mattson | 239/300 |
| 4,953,791 A | * | 9/1990 | Tada | 239/333 |
| 4,959,159 A | | 9/1990 | Mattson | 239/526 |
| 5,094,402 A | | 3/1992 | Perret, Jr. et al. | 239/526 |
| 5,271,564 A | | 12/1993 | Smith | 239/532 |
| 5,429,307 A | * | 7/1995 | Darroch | 239/390 |
| 5,469,993 A | | 11/1995 | Hauf et al. | 222/383.3 |
| 5,609,302 A | | 3/1997 | Smith | 239/526 |
| 5,669,557 A | * | 9/1997 | Barrett et al. | 239/135 |
| 6,029,909 A | | 2/2000 | Smith | 239/318 |
| 6,168,093 B1 | | 1/2001 | Greer, Jr. et al. | 239/332 |
| 6,319,453 B1 | | 11/2001 | Klima, Jr. et al. | 264/504 |
| 6,425,536 B2 | * | 7/2002 | Namura | 239/390 |
| 6,427,931 B1 | * | 8/2002 | Guo | 239/526 |
| 6,431,468 B1 | * | 8/2002 | Brown et al. | 239/526 |
| 6,585,173 B2 | * | 7/2003 | Schmon et al. | 239/526 |
| 2001/0040192 A1 | * | 11/2001 | Kaneko et al. | 239/414 |

FOREIGN PATENT DOCUMENTS

DE 003342214 A1 * 5/1985

* cited by examiner

*Primary Examiner*—William C. Doerrler
*Assistant Examiner*—Mohammad M. Ali
(74) *Attorney, Agent, or Firm*—Dorsey & Whitney LLP

(57) ABSTRACT

Modular spray gun apparatus and methods are disclosed. In one embodiment, an apparatus includes a handle module and a head module that is removeably coupled to the handle module. The head module includes a first housing having an inlet adapted to be coupled to a source of pressurized gas, a flow passage extending between the inlet and an outlet, and a first coupling member proximate the outlet. Similarly, the head module includes a second housing having a second coupling member removeably coupled to the first coupling member of the first housing, a nozzle fluidly communicating with a spray outlet, and a needle assembly operatively associated with the nozzle to control a flow of liquid material and pressurized gas emanating from a mixing passage through the nozzle.

20 Claims, 3 Drawing Sheets

MODULAR SPRAY GUN APPARATUS AND METHODS

TECHNICAL FIELD

The present invention relates to equipment for applying liquid coating materials to a surface, and more particularly, to modular spray gun apparatus and methods.

BACKGROUND OF THE INVENTION

A wide variety of spray equipment for applying liquids such as paint, varnish, cleaning solvents, or other liquid materials to a surface are known. Typically, such spray equipment includes a spray gun having a needle assembly, a flow nozzle, and an air cap that are selected as an operating set based on the viscosity of the liquid that is being sprayed. For example, when painting an automobile, a first operating set of needle assembly, flow nozzle, and air cap may be used for applying a base coat, a second operating set of these components may be used for applying a top coat, and a third operating set of these components may be used for applying a clear coat.

Prior art spray apparatus are generally characterized as having many individual parts that are assembled together in a complex, highly interdependent manner into a single housing. Using a prior art spray apparatus, when an operator decides to change one of the or more of the parts, such as the needle assembly, the operator must laboriously disassemble numerous other parts of the spray apparatus to get to the needle assembly. Thus, in the above-referenced example of painting an automobile, when the operator desires to switching from a first operating set (i.e. needle assembly, nozzle, and air cap) to a second operating set, the spray apparatus must be meticulously disassembled, and each individual component (needle assembly, flow nozzle, and air cap) individually replaced. Then, prior to using the spray equipment, all of the replacement components of the second operating set must be reinstalled into the housing. This process takes considerable time and effort each time the operator desires to switch from one operating set to another, thereby decreasing operational efficiency of the spray equipment and increasing the cost of performing the job.

Another consideration is that the needle assembly typically includes a very fine-pointed needle that serves as a fluid valve and which operates to provide a finely-metered flow of liquid material through the nozzle. During disassembly and handling of the plurality of components of the prior art spray apparatus, there is an increased risk of dropping or otherwise mishandling the fine-pointed needle that may result in damage, thereby adversely impacting the performance and operability of the spray assembly.

SUMMARY OF THE INVENTION

The present invention is directed to modular spray gun apparatus and methods. In one aspect, a modular spray apparatus includes a handle module and a head module that is removeably coupled to the handle module. The head module includes a first housing having an inlet adapted to be coupled to a source of pressurized gas, a flow passage extending between the inlet and an outlet, and a first coupling member proximate the outlet. Similarly, the head module includes a second housing having a second coupling member removeably coupled to the first coupling member of the first housing, the second housing including a first intake port fluidly communicating with the outlet of the handle module, a second intake port adapted to be coupled to a source of liquid material, and a mixing passage fluidly communicating with the first and second intake ports and with a spray outlet. The head module further includes a nozzle fluidly communicating with the spray outlet, and a needle assembly operatively coupled to the second housing and operatively associated with the nozzle to control a flow of liquid material and pressurized gas emanating from the mixing passage through the nozzle. The head module is removeably coupled to the handle module, and may be de-coupled from the handle module without disassembly of the either the head module or the handle module.

DETAILED DESCRIPTION OF THE INVENTION

The present disclosure is generally directed toward novel modular spray gun apparatus and methods. Many specific details of certain embodiments of the invention are set forth in the following description and in FIGS. 1–5 to provide a thorough understanding of such embodiments. One skilled in the art will understand, however, that the present invention may have additional embodiments, or that the present invention may be practiced without several of the details described in the following description.

Figure 1:
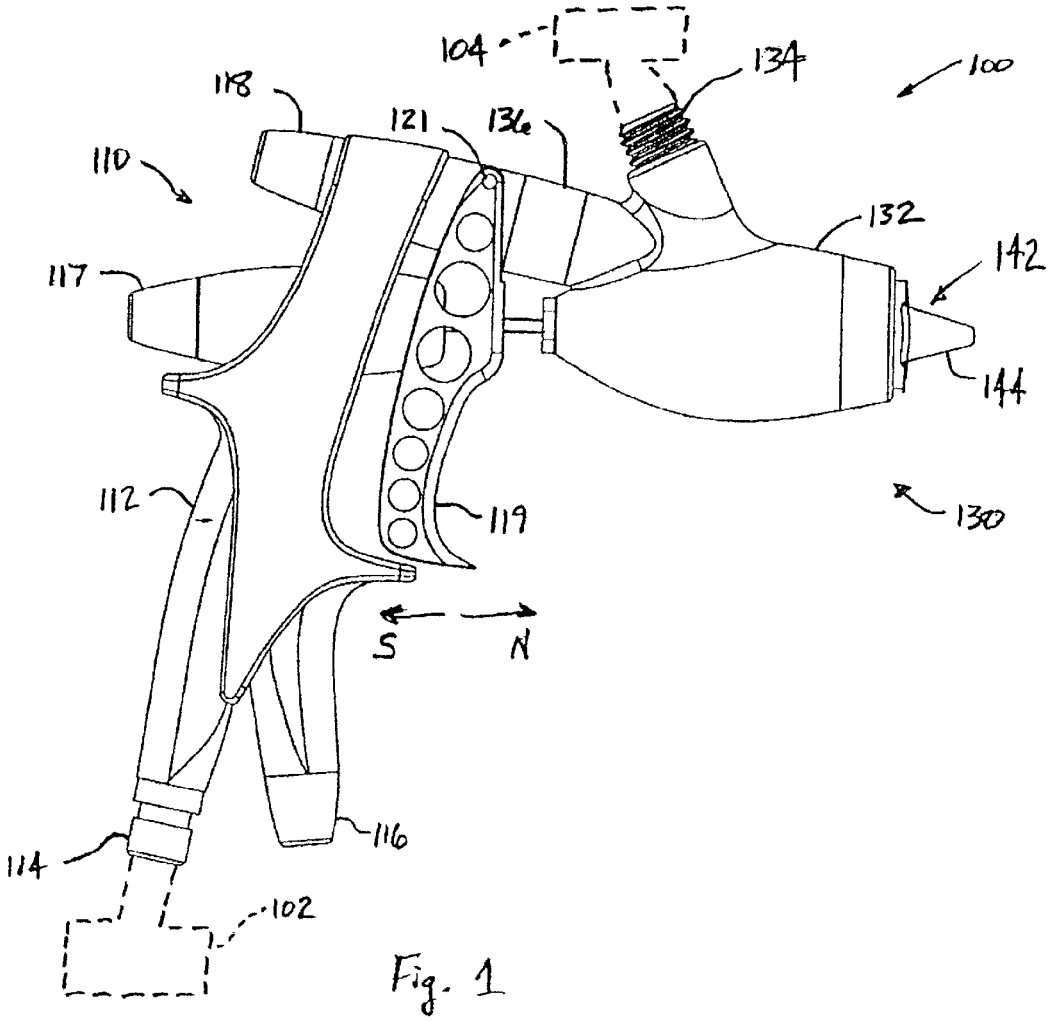
FIG. 1 is a side elevational view of a sprayer assembly in accordance with an embodiment of the invention.
Figure 2:
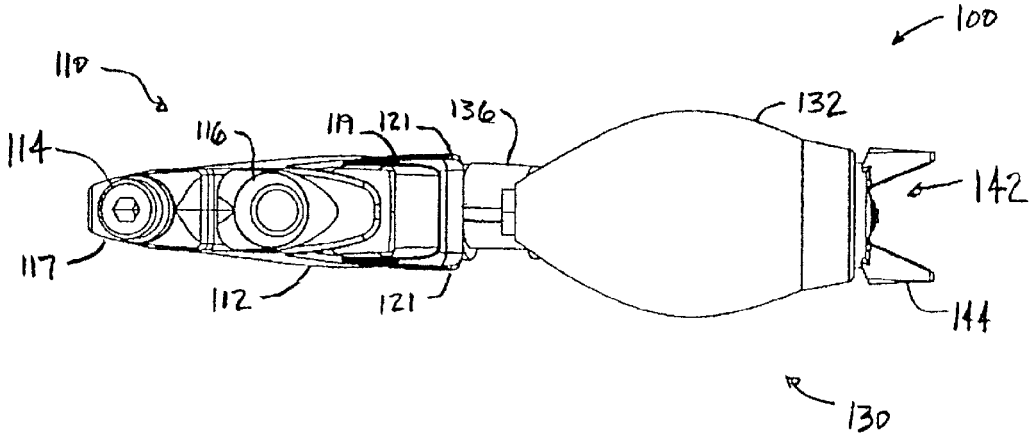
FIG. 2 is a bottom elevational view of the sprayer assembly of FIG. 1.
Figure 3:
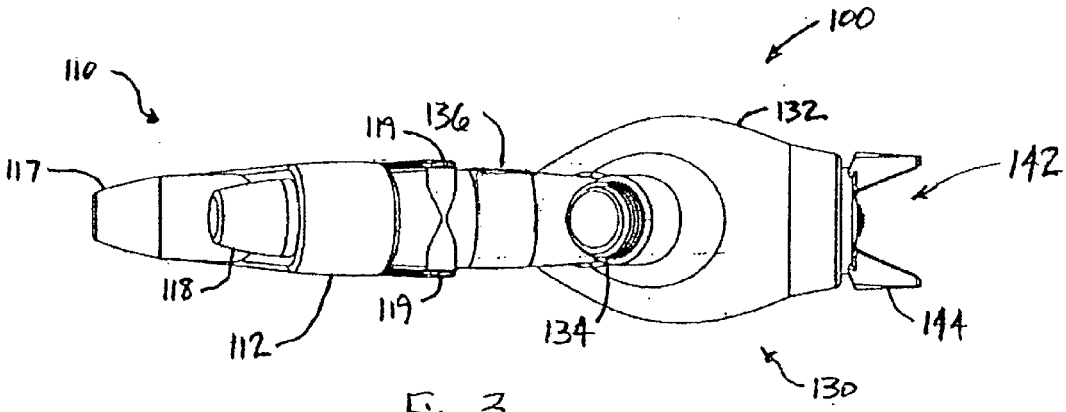
FIG. 3 is a top elevational view of the sprayer assembly of FIG. 1.

FIG. 1 is a side elevational view of a sprayer assembly 100 in accordance with an embodiment of the invention. FIGS. 2 and 3 are bottom and top elevational views, respectively, of the sprayer assembly of FIG. 1. As shown in FIGS. 1–3, the sprayer assembly 100 includes a handle module 110 and a head module 130. As described more fully below, the head module 130 of the inventive sprayer assembly 100 is removeably coupled to the handle module 110, and may be de-coupled from the handle module 110 without disassembly of the either the head module 130 or the handle module 110.

As further shown in FIGS. 1–3, the handle module 110 includes a first housing 112 having an inlet 114 disposed in a lower portion thereof. The inlet 114 is adapted to be coupled to a source of pressurized gas 102 (FIG. 1), such as an air compressor, a gas bottle, or the like. A first control knob 116 is operatively coupled to the first housing 112 proximate the inlet 114. A second control knob 117 and a third control knob 118 are also operatively coupled to the first housing 112. As described more fully below, the control knobs 116–118 enable an operator (not shown) to controllably adjust a flow of pressurized gas from the source of pressurized gas 102 through the handle module 110. A trigger 119 is pivotally coupled to the first housing 112 by pivot pins 121.

The head module 130 includes a second housing 132 having a first intake port 134 adapted to be coupled to a source of liquid material 104 (FIG. 1). The source of liquid material 104 may be any type of known source, such as, for example, a gravity-fed supply bottle, a pressurized vessel, a supply hose, or any other source capable of supplying a liquid material that is suitable for sprayable application onto a surface, including, for example, paint, varnish, clear coat, wax, stain, water, cleaner, stripper, and solvent. The head module 130 further includes a threaded coupling member 136 that couples the head module 130 to the handle module 110, as described more fully below.

Figure 4:
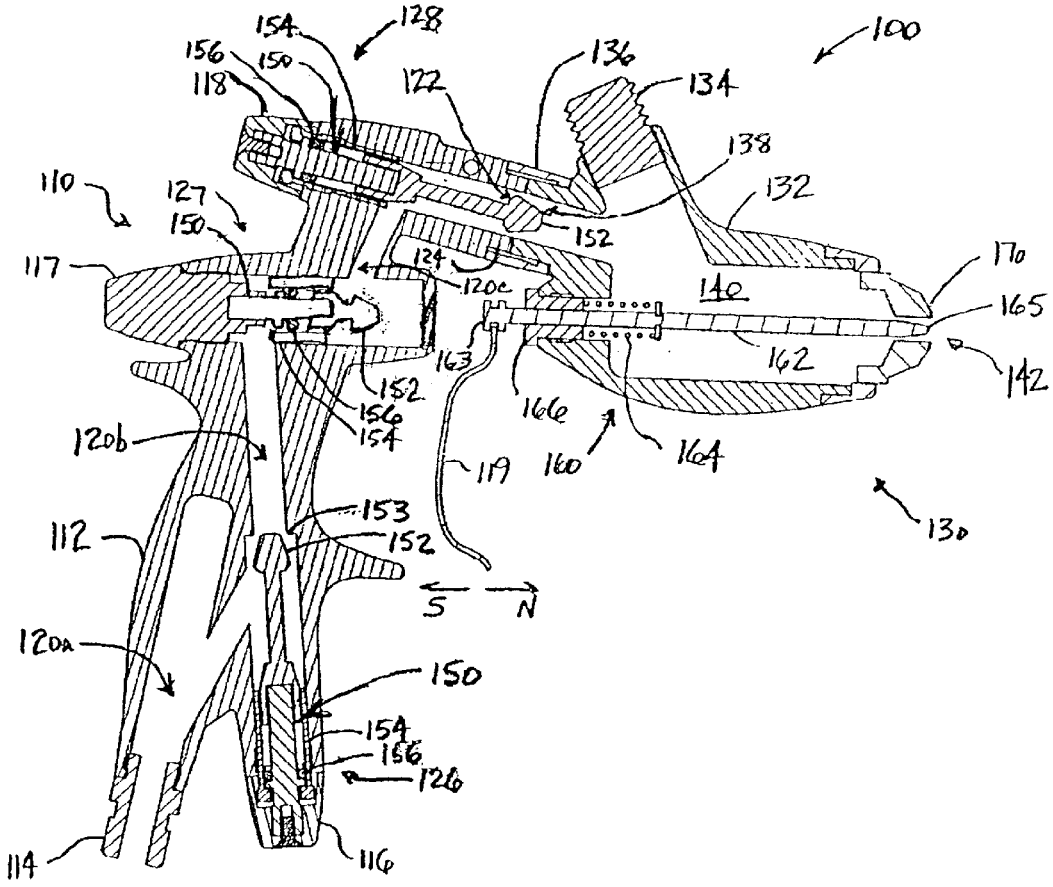
FIG. 4 is a side cross-sectional view of the sprayer assembly of FIG. 1.
Figure 5:
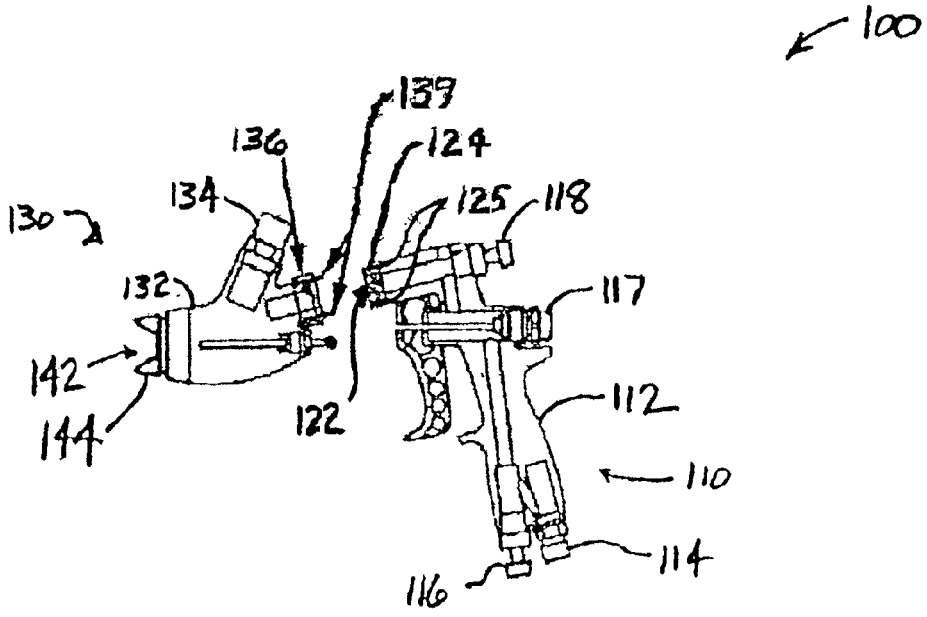
FIG. 5 is a partially disassembled side elevational view of the sprayer assembly of FIG. 1.

FIG. 4 is a side cross-sectional view of the sprayer assembly 100 of FIG. 1. FIG. 5 is a partially disassembled side elevational view of the sprayer assembly 100 of FIGS. 1–4. As best shown in FIG. 4, the handle module 110 has a flow passage 120 disposed therethrough that extends from the inlet 114 to an outlet 122. A threaded engagement portion 124 is circumferentially disposed about the outlet 122 and is threadedly coupled to the threaded coupling member 136 of the head module 130. Similarly, the head module 130 includes a second intake port 138 disposed within the threaded coupling member 136 and aligned with the outlet 122 of the handle module 110. The first and second intake ports 134, 138 are fluidly coupled to a mixing passage 140 having a spray outlet 142. As shown in FIG. 5, one or more guide pins 139 (two shown) may project outwardly from the head module 130 and may be slideably received into corresponding guide receptacles 125 disposed in the first housing 112 of the handle module 110.

It should be noted that, in alternate embodiments, the head module 130 may be removeably coupled to the handle module 110 using any suitable attachment device, including, for example, quick disconnect couplings. Also, the threaded coupling member 136 could be part of the handle module 110 and the threaded engagement portion 124 could be part of the head module 130, or both the head and handle modules could includes a threaded engagement portion 124, and the threaded coupling member 136 could be a separate component. Alternately, the guide pins 139 and guide receptacles 125 may be omitted. Any other type of suitable coupling assembly could be used.

As further shown in FIG. 4, the head module 130 also includes a needle assembly 160 and a nozzle 170 coupled to the spray outlet 142. The needle assembly 160 includes a needle 162, a biasing spring 164, and a seat member 166. The needle 162 has a first end 163 removeably coupled to the trigger 119, and a second end 165 operatively engaging the nozzle 170. A biasing spring 164 is disposed about the needle 162 and biases the needle 162 away from the seat member 166 toward the nozzle 170. An air cap 144 is coupled to the second housing 132 and is disposed about the spray outlet 142.

In operation, the sprayer assembly 100 is coupled to the source of pressurized gas 102 and to the source of liquid material 104. The biasing spring 164 biases the needle 162 into engagement with the nozzle 170, thereby closing the spray outlet 142 and preventing any liquid material from emanating from the head module 130. When the operator desires to apply the liquid material, the trigger 119 is pulled in a first direction S toward the first housing 112 of the handle module 110, drawing the needle 162 away from the nozzle 170 and opening the spray outlet 142. Pressurized gas from the source 102 flows through the flow passage 120 and out of the outlet 122 of the handle module 110, into the second intake port 138 of the head module 130. Liquid material is drawn from the liquid material supply 104 into the first intake port 134 and mixes with the pressurized gas in the mixing passage 140. The mixture of liquid material and pressurized gas then flows through the spray outlet 142 and is expanded outwardly through the nozzle 170 and the air cap 144 in a desirable spray pattern. When the operator releases the trigger 119, the biasing spring 164 forces the needle 162 back into engagement with the nozzle 170, moving the trigger 119 into a second direction N and shutting off the flow of mixed liquid material and gases emanating from the spray outlet 142.

The sprayer device 100 exhibits improved operational efficiency over prior art spray apparatus. When the operator desires to change to a different operating set (needle, nozzle, and air cap), such as, for example, when switching from a base coat to a top coat while painting an automobile, the operator simply removes the entire head module 130 from the handle module 110 as a single unit. This is accomplished by uncoupling (e.g. unthreading) the first end 163 of the needle 162 from the trigger 119, and uncoupling the threaded coupling member 136 from the threaded engagement portion 124 of the handle module 110. The operator may then couple a second head module (not shown) having a different needle assembly, nozzle, and air cap suitable for application of the top coat. Thus, by having a set of head modules suitable for application of a variety of liquid materials, the operator may quickly and efficiently change the spray characteristics of the sprayer device 100 to accommodate the viscosity of any liquid material that is to be applied. This process takes considerably less time and effort than changing the operating configuration of the prior art spray equipment, thereby increasing operational efficiency and decreasing the cost of performing the job.

Furthermore, because the needle assembly 160 remains within the head module 130 as a unit, there is far less chance for the needle 162 to be damaged during changes of the head module 130. Because the needle assembly 160 remains within the head module 130 as a unit, it is not necessary to disassemble and handle the needle and other components of the operating set. Thus, the risk of dropping or otherwise mishandling the needle 162 is reduced or eliminated, thereby improving the operability of the spray assembly.

Referring again to FIG. 4, the handle module 110 also includes a first valve assembly 126 coupled to the first control knob 116, a second valve assembly 127 coupled to the second control knob 117, and a third valve assembly 128 coupled to the third control knob 118. The first, second, and third valve assemblies 126–128 each include a jack screw 150 attached to the respective first, second, or third control knob 116–118, and a center body 152 coupled to the jack screw 150. The valve assemblies 126–128 also include a sleeve 154 disposed about a portion of the jack screw 150 that is fixed relative to the first housing 112, and an O-ring seal 156 positioned between the jack screw 150 and the sleeve 154.

It should be noted that, in alternate embodiments, the valve assemblies 126–128 may be replaced with any suitable, conventional valve assemblies. Alternately, the valve assemblies 126–128 may simply be eliminated.

In operation, the first valve assembly 126 controls the flow of pressurized gas from a first portion 120*a* of the flow passage 120 into a second portion 120*b* of the flow passage 120. As the first control knob 116 is turned in a first (or clockwise) direction 157, the corresponding jack screw 150 of the first valve assembly 126 advances inwardly, causing the center body 152 to advance inwardly against a seat 153 formed in the wall of the flow passage 120, thereby decreasing the flow of pressurized gas from the first portion 120*a* into the second portion 120*b* of the flow passage 120. As the first control knob 116 is turned in a second (or counterclockwise) direction 158, the corresponding jack screw 150 and center body 152 of the first valve assembly 126 are withdrawn away from the seat 153, thereby allowing more pressurized gas to flow from the first portion 120*a* into the second portion 120. Similarly, the second valve assembly 127 is operated to control the flow of pressurized gas from the second portion 120*b* of the flow passage 120 into a third portion 120*c* using the second control knob 117, and the third valve assembly 128 is operated to control the flow from the third portion 120*c* out through the outlet 122 using the third control knob 118.

The valve assemblies advantageously allow the flow of pressurized gas to be controlled through the various portions of the flow passage 120. The control knobs, however, do not move in and out with respect to the first housing 112. Because each jack screw 150 moves its associated center body 152 in or out as its respective control knob is turned, the control knob remains in a position proximate to the first housing 112 and does not go in and out with the center body 152. This helps to prevent damage to the control knob and to the valve assemblies.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other modular spray gun apparatus and methods, and not just to the embodiments described above and shown in the accompanying figures. Accordingly, the scope of the invention should be determined from the following claims.

What is claimed is:

1. A modular spray apparatus, comprising:

a handle module including a first housing having an inlet adapted to be coupled to a source of pressurized gas, a flow passage extending between the inlet and an outlet, and a first coupling member proximate the outlet; and a head module including a second housing having a second coupling member removeably coupled to the first coupling member of the first housing, the second housing including a first intake port fluidly communicating with the outlet of the handle module, a second intake port adapted to be coupled to a source of liquid material, a mixing passage fluidly communicating with the first and second intake ports and with a spray outlet, the head module further including a nozzle fluidly communicating with the spray outlet, and a needle assembly operatively coupled to the second housing and operatively associated with the nozzle to control a flow of liquid material and pressurized gas emanating from the mixing passage through the nozzle, whereby the second coupling member of the head module may be de-coupled from the first coupling member of the handle module without disassembly of the head module.

2. The apparatus according to claim 1 wherein the first coupling member comprises a first removable coupling device positioned on the outlet and the second coupling member comprises a second removable coupling device configured to detachably couple to the first removable coupling device and positioned on the first intake port.

3. The apparatus according to claim 1 wherein the handle module further includes a trigger moveably coupled to the first housing, the needle assembly projecting from the head module and being removeably coupled to the trigger.

4. The apparatus according to claim 1 wherein the handle module further includes at least one valve assembly that includes a control knob projecting from the first housing, a screw jack coupled to the control knob, and a center body coupled to the screw jack that controls a flow of pressurized gas between a first and second portions of the flow passage.

5. The apparatus according to claim 1 wherein the head module further includes an air cap coupled to the second housing proximate the nozzle.

6. The apparatus according to claim 1, further comprising a supply vessel coupled to the second intake port.

7. The apparatus according to claim 1, further comprising a source of pressurized gas coupled to the inlet of the handle module.

8. An assembly for applying a liquid material, comprising:

a source of liquid material;

a source of pressurized gas; and a spray device coupled to the source of liquid material and to the source of pressurized gas, the spray device comprising a handle module including a first housing having an inlet adapted to be coupled to a source of pressurized gas, a flow passage extending between the inlet and an outlet, and a first coupling member proximate the outlet; and a head module including a second housing having a second coupling member removeably coupled to the first coupling member of the first housing, the second housing including a first intake port fluidly communicating with the outlet of the handle module, a second intake port adapted to be coupled to a source of liquid material, a mixing passage fluidly communicating with the first and second intake ports and with a spray outlet, the head module further including a nozzle fluidly communicating with the spray outlet, and a needle assembly operatively coupled to the second housing and operatively associated with the nozzle to control a flow of liquid material and pressurized gas emanating from the mixing passage through the nozzle, whereby the second coupling member of the head module may be de-coupled from the first coupling member of the handle module without disassembly of the head module.

9. The assembly according to claim 8 wherein the first coupling member comprises a first removable coupling device positioned on the outlet and the second coupling member comprises a a second removable coupling devices configured to detachably couple to the first removable coupling device and positioned on the first intake port.

10. The assembly according to claim 8 wherein the handle module further includes a trigger moveably coupled to the first housing, the needle assembly projecting from the head module and being removeably coupled to the trigger.

11. The assembly according to claim 8 wherein the handle module further includes at least one valve assembly that includes a control knob projecting from the first housing, a screw jack coupled to the control knob, and a center body coupled to the screw jack that controls a flow of pressurized gas between a first and second portions of the flow passage.

12. The assembly according to claim 8 wherein the head module further includes an air cap coupled to the second housing proximate the nozzle.

13. A method of applying a liquid material to a surface, comprising:

providing a handle module including a first housing having an inlet adapted to be coupled to a source of pressurized gas, a flow passage extending between the inlet and an outlet;

providing a head module including a second housing removeably coupleable to the first housing, the second housing including a first intake port adapted to fluidly communicate with the outlet of the handle module, a second intake port adapted to be coupled to a source of liquid material, and a mixing passage fluidly communicating with the first and second intake ports and with a spray outlet, the head module further including a nozzle fluidly communicating with the spray outlet, and a needle assembly operatively coupled to the second housing and operatively associated with the nozzle to control a flow of liquid material and pressurized gas emanating from the mixing passage through the nozzle, whereby the head module may be de-coupled from the handle module without disassembly of the head module;

coupling the head module to the handle module;

coupling a source of pressurized gas to the inlet of the handle module;

coupling a source of liquid material to the second intake port of the head module;

flowing liquid material from the source of liquid material through the second intake port and into the mixing passage;

flowing pressurized gas from the source of pressurized gas through the handle module and into the mixing passage; and flowing a mixture of liquid material and pressurized gas from the mixing passage through the nozzle of the head module.

14. The method according to claim 13 wherein coupling the head module to the handle module comprises detachably coupling the head module to the handle module.

15. The method according to claim 13, further comprising de-coupling the head module from the handle module without disassembly of the head module.

16. The method according to claim 15, further comprising coupling a second head module to the handle module.

17. The method according to claim 13 wherein coupling a source of liquid material to the second intake port of the head module comprises coupling a gravity-fed supply vessel to the second intake port of the head module.

18. The method according to claim 13 wherein coupling a source of pressurized gas to the inlet of the handle module comprises coupling an air compressor to the inlet of the handle module.

19. The method according to claim 13 wherein flowing liquid material from the source of liquid material through the second intake port and into the mixing passage comprises flowing a liquid coating material through the second intake port and into the mixing passage.

20. The method according to claim 13 wherein flowing liquid material from the source of liquid material through the second intake port and into the mixing passage comprises flowing a liquid cleaning material through the second intake port and into the mixing passage.

* * * * *

UNITED STATES PATENT AND TRADEMARK OFFICE

CERTIFICATE OF CORRECTION

PATENT NO. : 6,874,702 B2
APPLICATION NO. : 10/267632
DATED : April 5, 2005
INVENTOR(S) : Clifford W. Turnbull It is certified that error appears in the above-identified patent and that said Letters Patent is hereby corrected as shown below:

| Column, Line | Reads | Should Read |
|---|---|---|
| (73) Assignee: | "Micron Technology, Inc." | -- -- |

Signed and Sealed this
Fifteenth Day of November, 2011

David J. Kappos

David J. Kappos
*Director of the United States Patent and Trademark Office*